United States Patent [19]

Scieri et al.

[11] Patent Number: 4,509,641

[45] Date of Patent: Apr. 9, 1985

[54] TWO PART MIXABLE COMPONENT STORAGE CONTAINER FOR WHIPPED CREAM IN FLAVORS AND CORRESPONDING COLORS, AND THE LIKE

[75] Inventors: Frank Scieri, 85 W. 18th St., Deer Park, N.Y. 11729; Richard L. Miller, Dix Hills, N.Y.

[73] Assignee: Frank Scieri, Deer Park, N.Y.

[21] Appl. No.: 443,048

[22] Filed: Nov. 19, 1982

[51] Int. Cl.[3] ..... B65D 25/08; B65D 83/14

[52] U.S. Cl. ..... 206/219; 220/20; 222/95

[58] Field of Search ..... 222/94, 95, 96, 107, 222/136, 129; 206/219, 221; 220/20

[56] References Cited

U.S. PATENT DOCUMENTS

| | | | |
|---|---|---|---|
| 933,444 | 9/1909 | Henke, Jr. | 206/219 X |
| 1,706,335 | 3/1929 | Toch | 206/221 X |
| 2,973,883 | 3/1961 | Modderno | 222/136 X |
| 3,241,722 | 3/1966 | Nissen | 222/136 |
| 4,189,069 | 2/1980 | Stoody | 222/94 X |
| 4,212,337 | 7/1980 | Kamp | 383/63 |

*Primary Examiner*—Joseph J. Rolla
*Assistant Examiner*—Frederick R. Handren
*Attorney, Agent, or Firm*—Richard L. Miller

[57] ABSTRACT

A device for separately storing multiple mixable components prior to use and allowing for, at a subsequent date, their mixing. The device or system being ideally suited for dispensing whip cream in flavors and corresponding colors or epoxy and hardener. The device has two separate containers from which metered proportions are mixed when needed.

3 Claims, 4 Drawing Figures

TWO PART MIXABLE COMPONENT STORAGE CONTAINER FOR WHIPPED CREAM IN FLAVORS AND CORRESPONDING, AND THE LIKE

BACKGROUND OF THE INVENTION

This invention relates to devices for storing and subsequently mixing of materials, but more particularly to devices which can be reused depending upon the chemical nature of the materials. U.S. Pat. Nos. 3,241,722 to Nissen and 3,454,198 and 3,508,685 to Flynn teach a dispensing device for two materials stored in two containers but make no mention of a collapsible second container necessary to dispense contents while only one material is under pressue. U.S. Pat. No. 3,896,971 to Schwede teaches a dispensing device for two materials stored in two containers, disclosing that one container would have to be collapsible. However, the two containers are not permanently affixed; that is, container 1 would have to be attached to the nozzle of container 2 to be used and removed when not in use. The valve assembly mentions no means of internal mixing of the materials, plus utilization requires the pressing by hand of both the second bag and the nozzle being that the second bag is externally mounted. These inventions can be used to dispense whipped cream traced with color and/or flavoring but does not afford total mixing of components in the present invention.

SUMMARY OF THE INVENTION

It is an object of the present invention to provide a device that will store separately multiple mixing components and allow the mixing at a subsequent time.

It is another object of the present invention to provide a device that will store separately multiple mixable components and upon activation will mix and discharge them under pressure.

Still another object of the present invention is to provide a device that can be utilized at multiple instances or can be utilized only once decided upon by the nature of the mixable components.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
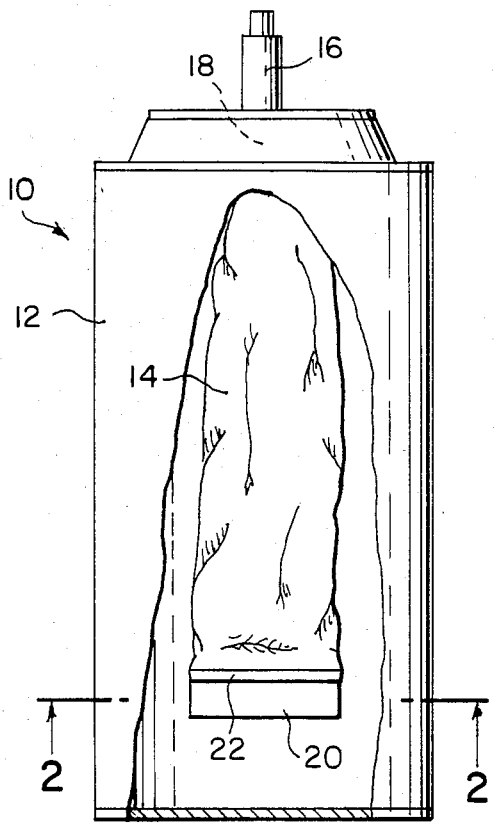
FIG. 1 is a cutaway side view of the present invention.
Figure 2:
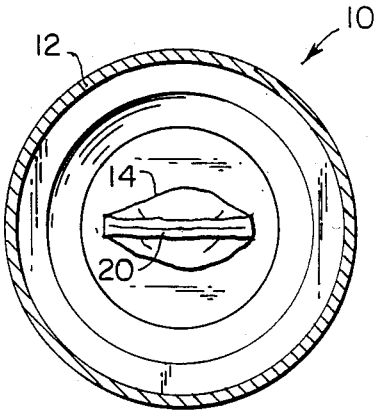
FIG. 2 is a horizontal section viw along lines 2—2 of the present invention in FIG. 1.

In FIGS. 1 and 2 the improved pressurized dispensing device of the present invention is shown generally at 10 utilizing a outer pressurized container 12 and a concentrically disposed secured non-pressurized inner container 14, i.e. a collapsible bag. Both containers having respective outlet orifices and a common valve assembly 18 for controlling the selective dispensing of the materials stored in the outer pressurizing container 12 and the inner non-pressurized container 14. A flexible tubular nozzle 16 activates the mixing when bent by the index finger of the user. The first outer container 12 contains a pressurized material (such as whip cream with a suitable propellent dissolved therewithin). The second container 14 contains a non-pressurized material. During storage the components are in equilibrium with each other that is to say that the pressure in the inner container 14 will be exactly the same as the outer container 12 because the inner 14 container is flexible. Bending nozzle 16, activates valve assembly 18 to open, which causes a disequilibrium in the materials, and thus pressurized material of outer container 12 now has a pressure gradient between its contents and the ambient. As the material of the outer container 12 enters the valve assembly 18 there also exists a pressure gradient between the ambient and that of the contents of the inner container 14. Being that inner container 14 is collapsible its contents is forced into valve assembly 18. Valve assembly 18 which is old in the art mixes the components and discharges them through nozzle 16 into the ambient for use.

In order that material may be easily placed within the inner bag container 14 at the time of manufacture the bottom edge 20 of bag 14 may be sealed with a ZIPLOC® type element 22 so that the bag may be closed without heat sealing machinery, or other special equipment.

Figure 3:
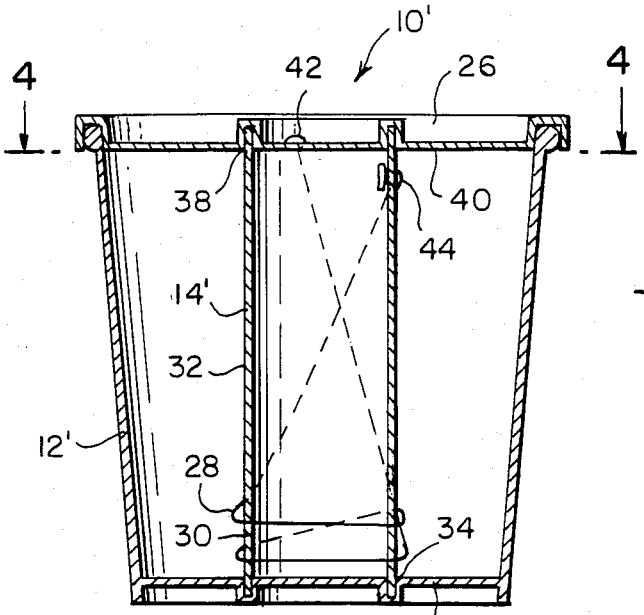
FIG. 3 is a vertical section of an alternative embodiment of the present invention of FIG. 1.
Figure 4:
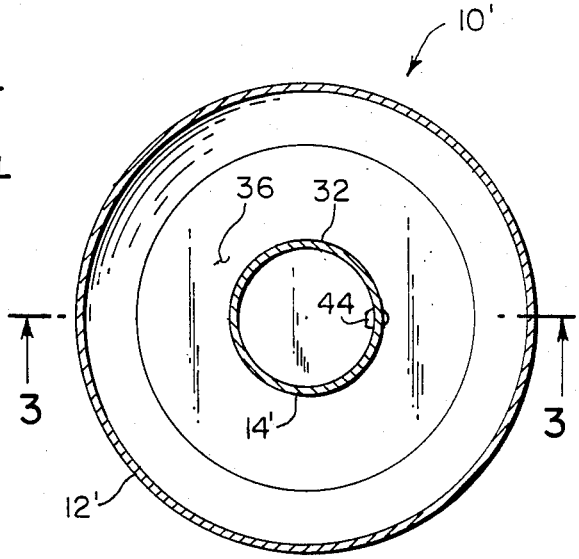
FIG. 4 is a horizontal section along lines 4—4 of the alternative embodiment of the present invention in FIG. 3.

FIG. 3 and 4, depicts an alternate embodiment of the invention generally shown at 10', with outer container 12' and a concentrically disposed inner container 14'. When lid 26 is removed from the outer and inner containers 12' and 14' respectively it causes lanyard 28 which is attached at one end at 42 to the lid 26 and is wound around the lower portion 30 of inner container 14' to ride up inner container 14' releasing the contents stored in outer container 12' from the perimeter 32 of inner container 14'. Ultimately, when the lanyard 28 is removed from around hollow cylinder 14' its other end, which is fastened to hollow cylinder 14' at 44 lifts hollow cylinder 14' out of outer container 12' and thereby allowing the separated materials in outer and inner containers to come in contact with each other for easier mixing and cleanliness for operation.

Inner container 14' is a cylindrical member preferably circular in cross section and is maintained in place by being snugly fitted in a recessed corresponding circular grove 34 of the bottom wall 36 of outer container 12'. In addition when lid 26 is placed upon the outer container 12', another second recessed corresponding circular grove 38 traps hollow cylinder inner container 14' member between bottom wall 36 of outer container 12' and the inner surface 40 of lid 26. As previously mentioned when the lid 26 is removed from both containers a lanyard 28 acts as a mold release by being pulled between the outer surface of 32 of inner container 14' and the contents in container 12' not shown.

It is to be further understood that the general nature of the contents of the outer container 12' is expected to be pasty or creamy in texture while the inner container 14' contents are probably a liquid in nature.

There are several application for this container system not to mention the first being the packaging of whip cream in the outer container and artificial (or natural) flavoring and colors in the inner container. This container now prevents the materials from mixing before the containers are opened by the user so that a fresh mix can be obtained at the time of use preventing the contents of one container from reacting with the other.

A second obvious use of this container system is the packaging of epoxy resin and catalytic hardener. The described container not only maintains the contents separate but also allow exact quantities in exact proportions to be mixed by the user without the need to handle the materials.

If it is absolutely necessary to prevent seepage of materials between inner and outer containers than any of several sealant type of materials (not shown) may be used in the recessed circular groves 34, and 38, such as wax, silicone compounds, plastic, rubber,etc.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

Note: ZIPLOC® is a trademark of The Dow Chemical Co.

What is claimed is:

1. A container for storing a first and second mixable component prior to the opening and allowing for mixing subsequent to opening, in combination comprising:

(a) an inverted hollow frustum having a first concentric groove disposed on its base;

(b) a removable hollow cylinder having a first end removably attached to said first concentric groove and being coaxial with said inverted hollow frustum, so that said first mixable component is stored within the confines of said hollow cylinder and said second mixable component is stored within the "ring" shaped area defined by said inverted hollow frustum and said hollow cylinder;

(c) a removable lid for placement on said inverted hollow frustum, having a second concentric groove disposed on its interior so that said lid, when placed on said inverted hollow frustum, will be in alignment for a second end of said hollow cylinder to be removably attached to said second concentric groove; and (d) a lanyard having a first fixed end to an underside of said lid and a second end fixed to an upper end of said hollow cylinder and being wound at least one turn around the lower hollow cylinder intermediate said first and second ends so that, upon removal of said lid, said turns of lanyard will ride up said hollow cylinder, causing said second mixable component to separate from the perimeter of said hollow cylinder and ultimately after said turns slide off the top of said hollow cylinder removes said removable hollow cylinder causing said first and second mixable component to come into direct contact for mixing.

2. The device as in claim 1 wherein said first mixable component is whipped cream and said second mixable component is flavored food coloring.

3. The device as claim 1 wherein said first mixable component is epoxy resin and said second mixable component is catalytic hardener.

* * * * *